US006715164B2

(12) United States Patent
Steadman et al.

(10) Patent No.: US 6,715,164 B2
(45) Date of Patent: Apr. 6, 2004

(54) BATH LIFT

(76) Inventors: William David Steadman, 2166 SE. Pyramid Rd., Port Saint Lucie, FL (US) 34952; William Lee Steadman, 10 Wulstan Dr., New Castle-Under-Lyme, ST5ORH (GB)

( * ) Notice: Subject to any disclaimer, the term of this patent is extended or adjusted under 35 U.S.C. 154(b) by 0 days.

(21) Appl. No.: 10/284,747

(22) Filed: Oct. 31, 2002

(65) Prior Publication Data

US 2003/0046756 A1 Mar. 13, 2003

Related U.S. Application Data

(63) Continuation-in-part of application No. 10/142,019, filed on May 9, 2002, which is a continuation-in-part of application No. 09/762,897, filed on Feb. 12, 2001, now abandoned.

(51) Int. Cl.[7] ..... A47K 3/02

(52) U.S. Cl. ..... 4/566.1; 4/560.1; 4/564.1; 4/565.1

(58) Field of Search ..... 4/450.1–566.1, 4/578.1, 579

(56) References Cited

U.S. PATENT DOCUMENTS

| | | | | | |
|---|---|---|---|---|---|
| 3,311,930 | A | * | 4/1967 | Bourke | 4/566.1 |
| 3,346,885 | A | | 10/1967 | Merriman | |
| 3,835,483 | A | * | 9/1974 | Emery et al. | 4/579 |
| 4,166,294 | A | * | 9/1979 | McGowan | 4/534 |
| 4,495,666 | A | * | 1/1985 | Herman, Jr. | 4/564.1 |
| 5,020,168 | A | | 6/1991 | Wood | |
| 5,579,544 | A | * | 12/1996 | Attler | 4/566.1 |
| 5,806,110 | A | * | 9/1998 | Kunz et al. | 4/566.1 |
| 5,855,028 | A | * | 1/1999 | Colbert | 4/563.1 |
| 6,353,943 | B1 | * | 3/2002 | Stevens | 4/582 |

FOREIGN PATENT DOCUMENTS

| | | |
|---|---|---|
| DE | 23 55 582 | 11/1973 |
| DE | 87 10 252.8 | 7/1987 |
| DE | 38 40213 A1 | 11/1988 |
| DE | 3840213 A1 | 5/1990 |
| GB | 2314765 | 1/1998 |
| GB | 2358797 | 8/2001 |
| WO | WO 00/09063 | 2/2000 |

OTHER PUBLICATIONS

British Search Report Dated Mar. 13, 2002, p. 1.
English Abstract for DE2840213–D2.

* cited by examiner

*Primary Examiner*—Tuan N. Nguyen
(74) *Attorney, Agent, or Firm*—Watts, Hoffmann Co., L.P.A.

(57) ABSTRACT

A bath lift including an inflatable part 10 locatable in a bath to raise or lower a person sitting thereon. The part 10 comprises a seat section 12 and a support section 20. The sections 12, 20 are connected in series such that with a person sitting on the part 10 the section 12 will deflate first, and when the part 10 is being inflated with a person sitting thereon the section 20 will inflate prior to the section 12.

19 Claims, 7 Drawing Sheets

BATH LIFT

This application is a continuation in part of application Ser. No. 10/142,019 filed May 9, 2002 which in turn was a CIP of Ser. No. 09/762,897 filed Feb. 12, 2001 (now abandoned) each entitled Bath Lift.

This invention concerns improvements in or relating to bath lifts, and particularly but not exclusively inflatable bath lifts.

In inflatable bath lifts an inflatable member is located in a bath and inflated such that a person can be supported thereby. The inflatable member is then deflated lowering the person into the bath to permit bathing. When the person wishes to exit the bath the inflatable member is reinflated lifting the person off the bottom of the bath to an elevated position from which they can leave the bath.

Problems are often encountered with existing inflatable bath lifts. For example, difficulties can be encountered in securing the bath lift in a bath so that it doesn't float, and also such that the bath lift is comfortable to sit on when deflated. The inflatable member may not inflate or deflate uniformly, such that a person can be tipped forwards, backwards and/or to one side.

According to the present invention there is provided a bath lift, the bath lift comprising an inflatable member locatable in a bath such that a person can sit thereon and be raised as the member is inflated, and lowered as the member is deflated, the inflatable member comprising an inflatable seat section, upon which a person can sit, and an inflatable support section the support section being adjacent the seat section and arranged such that when the support section is inflated and the seat section is at least partially deflated, the support section can provide support for a person sitting on the seat section.

The support section preferably extends on two opposite sides of the seat section. Preferably the support section extends on three sides of the seat section.

The support section preferably extends along the rear of the seat section and also along each side thereof. The support section may have a portion of increased width at the free end of each side thereof, and the seat section may have a front part of decreased width to accommodate the increased width portions of the support section.

The support section may comprise two separate inflatable side portions, and desirably also a separate rear portion. The rear portion may, when inflated, diverge upwardly. The rear portion may, when inflated, extend above the side portions and seat section. The rear portion, when inflated, may be inclined rearwardly, to, in use, generally conform to the shape of the end of a bath.

The inflatable member is preferably arranged such that during inflation with a person sitting on the seat section, the support section inflates substantially before the seat section, and during deflation with a person sitting thereon the seat section deflates substantially before the support section.

An air inlet, which also functions as an outlet, is preferably provided on the exterior of the seat section. The interiors of the seat and support sections are preferably interconnected in series such that air entering the support section has already passed through the seat section, and air exiting the support section passes into the seat section.

The inflatable member preferably comprises an inflatable base section, which base section is preferably located in use beneath the seat and support sections. The base section is preferably interconnected in series between the seat and support sections such that during inflation air enters the base section from the seat section, and air entering the support section enter from the base section.

One or more holes may be provided respectively between the seat and base, and support and base sections.

In one embodiment an inflatable bracing section may be provided, which bracing section extends from at least the rear of the support section, and perhaps also the rear of the base section. The bracing section is preferably engageable in use with the end of a bath, and may increase in width upwardly to, in use, generally conform to the shape of the end of a bath.

The bracing section is preferably connected in series with the support section such that air entering the bracing section comes from the support section. Alternatively, the bracing section is connected in parallel to the support section such that air entering thereinto passes from the base section.

The bath lift preferably also comprises a mounting arrangement for selective mounting of the inflatable member in a bath. The mounting arrangement preferably comprises a first mounting member or strip fixable on a bath, and a second mounting member on the inflatable member which is selectively engageable with the first member. Two first and second mounting members, or strips, may be provided, one of each on respective sides of the bath and inflatable member. The first and second mounting members may comprise profiled strips alignable substantially horizontally in use. The first member may have a substantially n-shape cross-section, and the second member may have a substantially u-shaped cross-section.

Alternatively, the first member may define a horizontally open channel with an opening of reduced width, and the second member may have substantially T-shaped cross-section but turned through 90 degrees, with the stem of the "T" extendible through the channel opening and the head of the "T" restrainably located in the channel, or vice-versa.

Alternative mounting means may be used, such as suckers on the underside and perhaps also the side of the inflatable member. Alternatively magnetic mounting means may be provided, which may comprise complimentary members locatable respectively on the inflatable member and a bath, or magnetic members locatable on the inflatable member and engageable with a metal bath.

The bath lift preferably also comprises a pump for selectively blowing into or sucking air out of, the inflatable member. The pump may be battery operated.

The bath lift preferably also comprises a control unit for operating the pump, and the control unit is preferably hand-held and remote from the pump. The control unit may float in water.

Embodiments of the present invention will now be described by way of example only and with reference to the accompanying drawings, in which.

Figure 1:
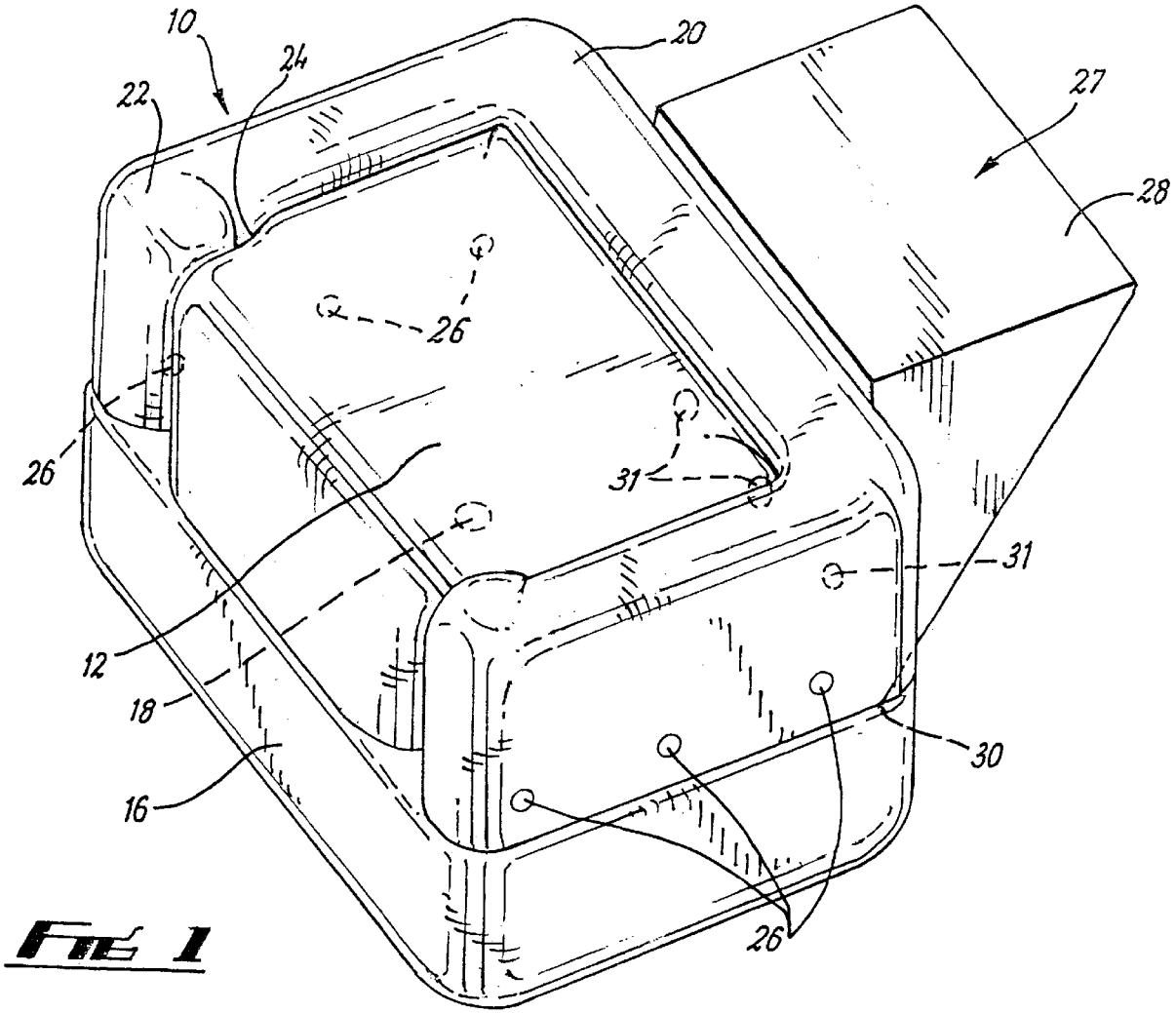
FIG. 1 is a diagrammatic perspective view of part of a first bath lift according to the invention.
Figure 2:
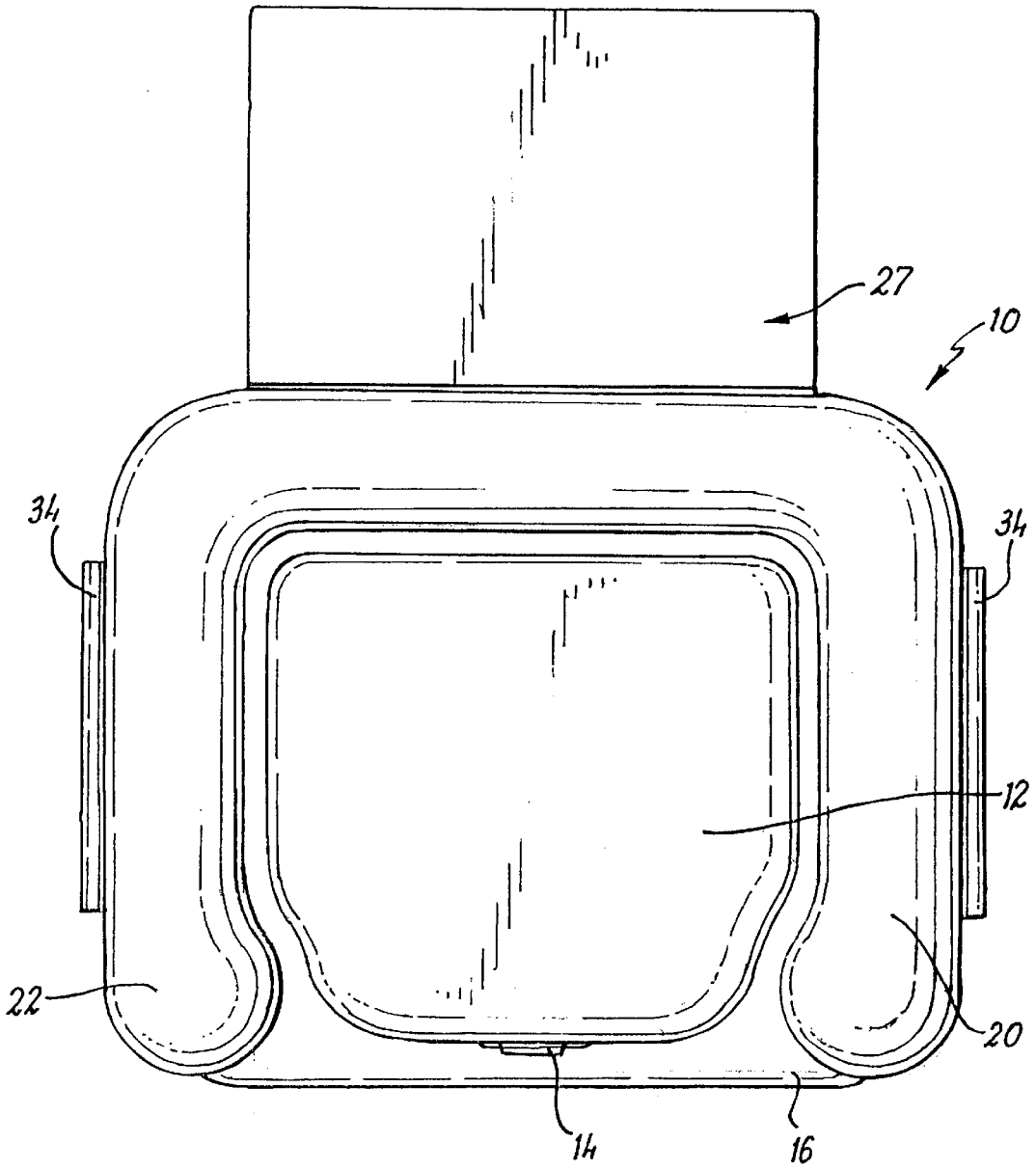
FIG. 2 is a diagrammatic plan view of the bath lift part of FIG. 1 incorporating an extra part.
Figure 3:
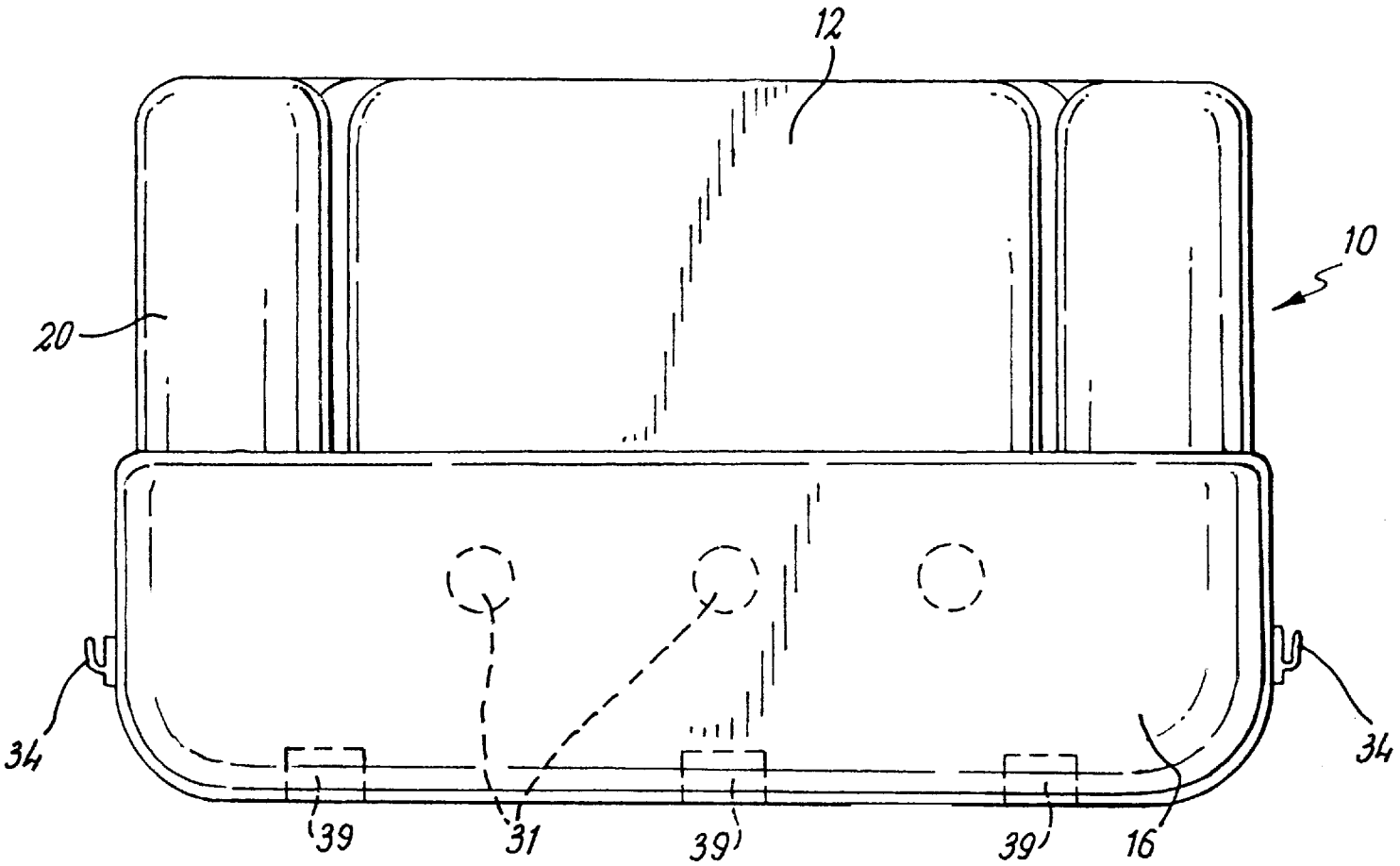
FIG. 3 is a diagrammatic front view of the bath lift parts of FIG. 2.

FIGS. 1 to 4 of the drawings show an inflatable part 10 of a first bath lift. The inflatable part 10 is locatable in a bath such that when fully inflated a person can sit thereon, the part 10 can then be deflated to lower the person into the bath to allow bathing. Once bathing is completed the part 10 is reinflated to raise the person in the bath to a position which they can readily get out of the bath.

The inflatable part 10 comprises a number of interconnected sections made from a flexible material. A first or seat section 12 defines an area upon which a person can sit. An inlet 14 is provided in the front of the section 12 to permit air to be blown thereinto or sucked therefrom. A second or base section 16 forms a base for the part 10 and extends underneath the seat section 12 and therebeyond in all directions, but only a small direction forwards. A central hole 18 provides for communication between the sections 12 and 16.

A third or support section 20 extends upwardly from the base section 16 to define in plan view (FIG. 2) an n-shape. The support section 20 surrounds the rear and two sides of the seat section 12, and when fully inflated reaches the same height. The free ends 22 of the sides of the section 20 are enlarged and extend inwardly towards the seat section 12. Correspondingly located recesses 24 are provided in the front of the seat section 12 to maintain a substantially constant spacing between the seat and support sections 12, 20. Three holes 26 are provided in the bottom of each side of the support section 20 in communication with the second base section 16.

A bracing section 27 extends rearwardly from the second and third sections 16, 20. The bracing section 27 is of a similar width to the seat section 12 and tapers inwardly from a flat upper portion 28 to a lower apex 30. Three holes 31 are provided between a lower part of the section 27 and the second base section 16.

A mounting arrangement 32 is provided (only shown in FIGS. 2 to 4) in the form of strips 34 on the sides of the base section 16. The strips 34 have a generally u-shape cross-section and engage with identical strips 36 mounted on a bath 38, but which strips 36 are inverted.

The bath lift also comprises (but not shown) a pump connected by a lead to the inlet 14, which pump is powered by a rechargeable battery. A remote floating hand-held controller is also provided for the pump.

Figure 4:
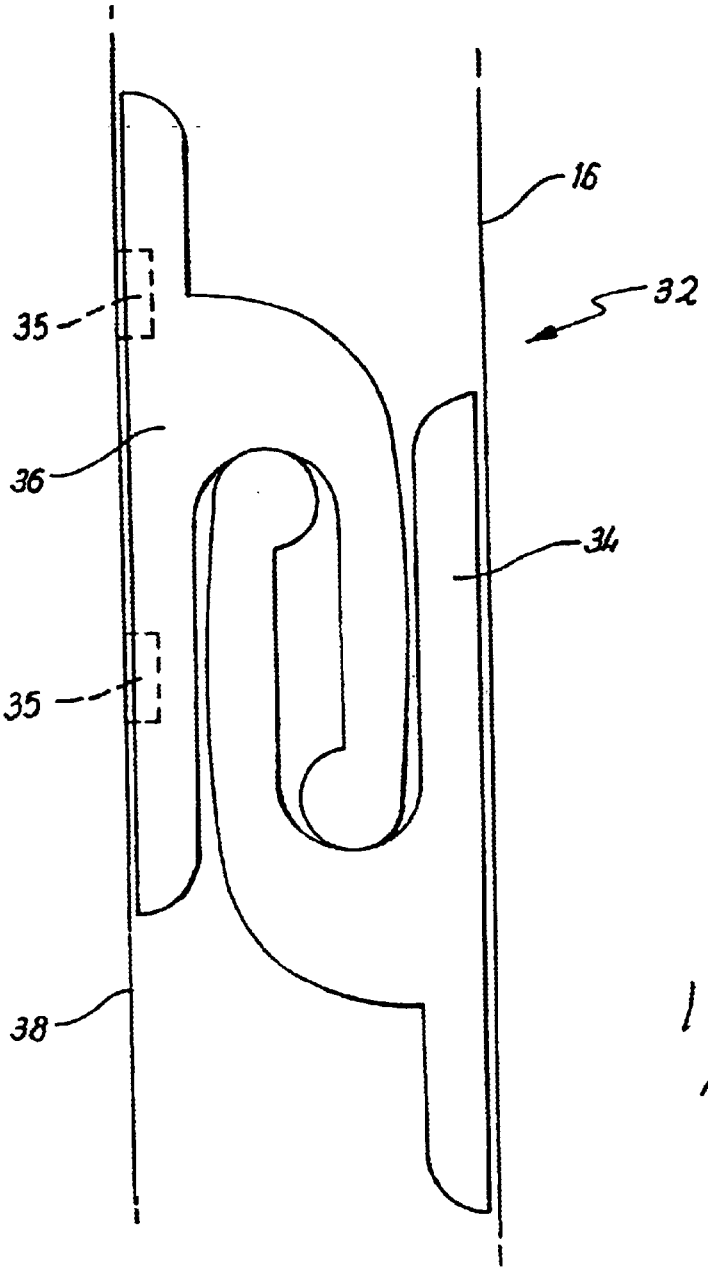
FIG. 4 is a diagrammatic side view of the extra part of FIG. 2.

In use, the strips 36 are fixed to the bath 38 in appropriate positions as by magnets 35, FIG. 4. The inflatable part 10, with the hose connected thereto, is located in the bath 38 and the strips 34 located in engagement with the strips 36. As a supplement to, or an alternate to, the strips 34, 36, further magnets 39 may be provided near the bottom of the base section 16, FIG. 3. When it is required to take a bath, the pump is actuated to pump air through the inlet 14. This causes all four sections 12, 16, 20, 27 to inflate by virtue of the communication holes 18, 26, 31. Once the inflatable part 10 is fully inflated and the bath full of water a person can sit on the seat section 12.

The pump is then reversed to suck air through the inlet 14. This initially causes the seat section 12 to deflate by virtue of the pressure applied thereto by a person sitting thereon. The person is therefore lowered into the bath whilst support and guidance is provided by the base section 16, and overall support is provided by the bracing section 27. Once the seat section 12 is fully deflated the base section 16 will deflate, again by virtue of the weight of the person pressing down thereon. Once the base section 16 has substantially fully deflated the support and bracing sections 20, 27 will deflate, thereby enabling the person to have a bath in a normal manner.

The mounting arrangements 32 are to the side and therefore do not affect a bather, and particularly are not sat on by a user of the bath lift which can otherwise be uncomfortable. It is to be realised that when the inflatable part 10 is inflated this causes the strip 34 to tend to rise and therefore secure engagement with the strip 36.

When a person has finished bathing the pump is reactivated to pump air through the inlet 14. By virtue of the weight of a person on the inflatable part 10, the first parts to substantially inflate will be the support and bracing sections 20, 27. This causes correct location of the inflatable part 10 and also the support section 20 to act as arms to support and guide the person. Once the sections 20, 27 are fully inflated, the base section 16 will inflate and thereafter the seat section 12, thereby raising the part 10 to the position shown in the drawings, at which position the person can get out of the bath 38.

There is thus described an inflatable bath lift which provides for significant advantages and provides for a secure raising and lowering of a person thereon. The support section 20 acts as a guide and also arm rests as a person is raised or lowered, and prevents for instance a person falling sideways. The enlarged ends 22 of the third section 20 prevent the first section 12 from collapsing forwards during inflation or deflation. The bracing section 27 helps to locate and brace the bath lift within a bath. The mounting arrangement 32 provides for an easy to use yet unobtrusive arrangement which does not affect a user and particularly their comfort. Whilst providing significant advantages the arrangement is of relatively straightforward construction, and operates primarily by the use of different sections and different interconnecting holes. Accordingly the apparatus can be inexpensively and robustly manufactured for reliable operation.

Figure 5:
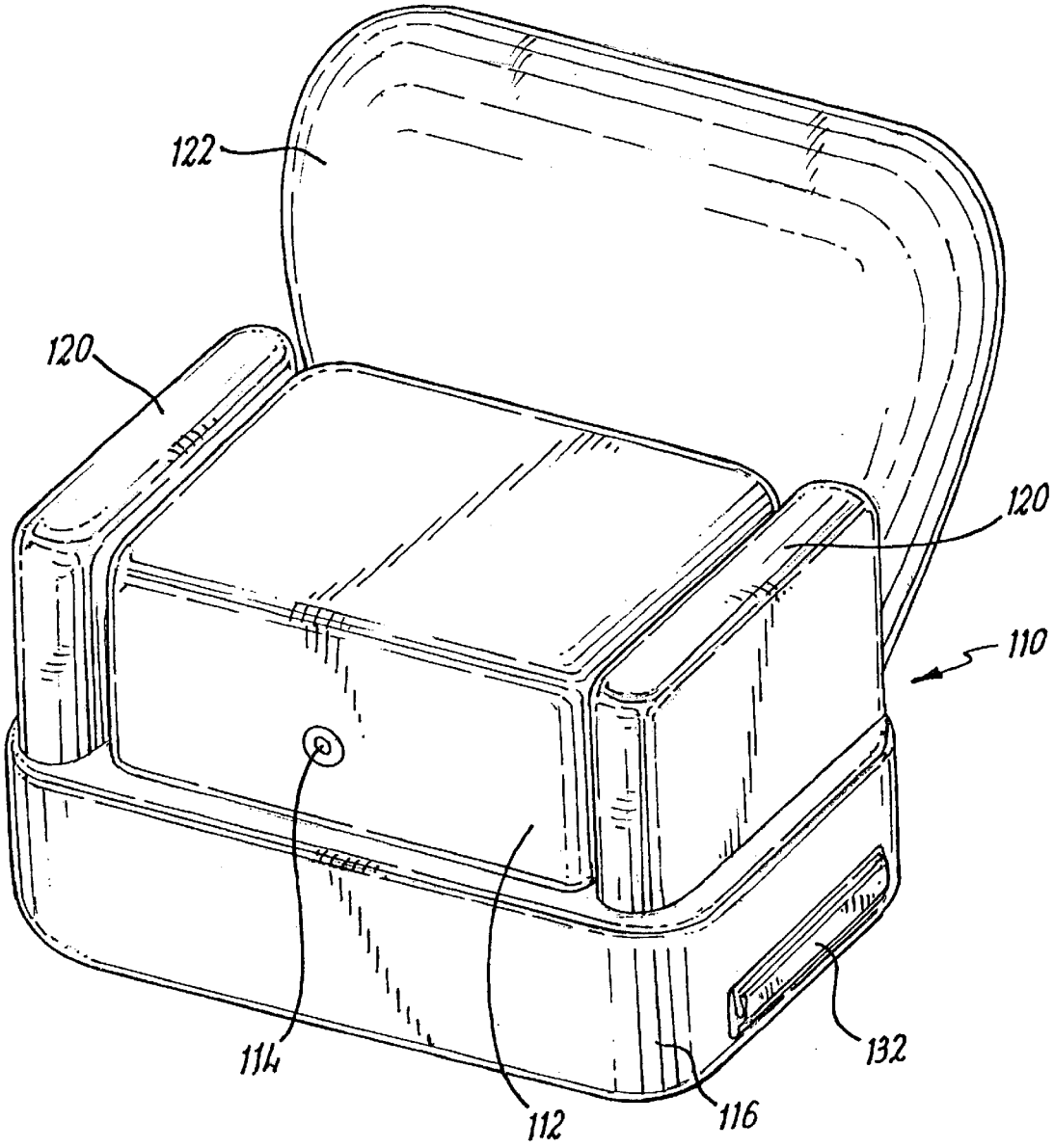
FIG. 5 is a similar view to FIG. 1 of part of a second bath lift according to the invention.
Figure 6:
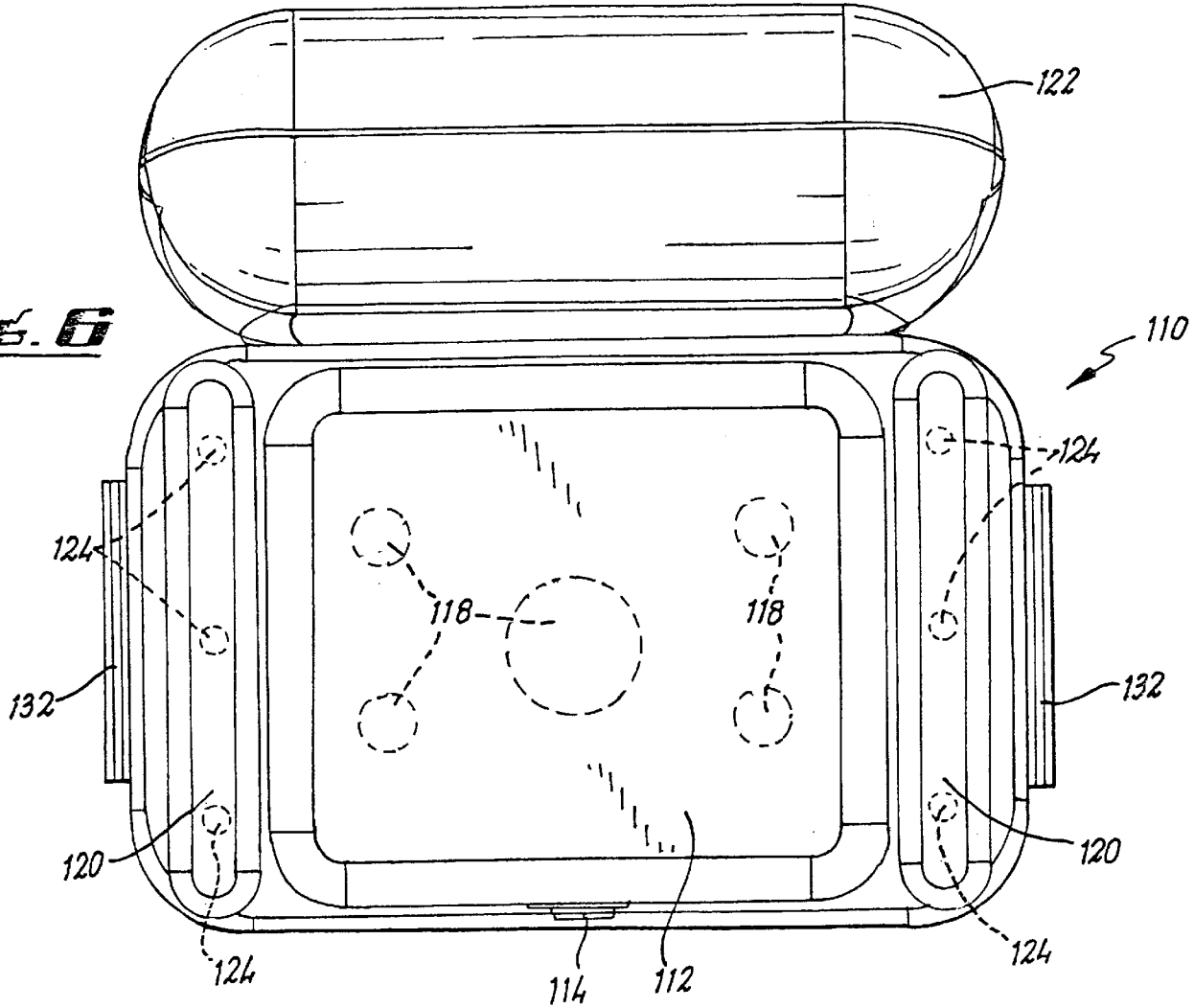
FIG. 6 is a similar view to FIG. 2 of the bath lift part of FIG. 5.
Figure 7:
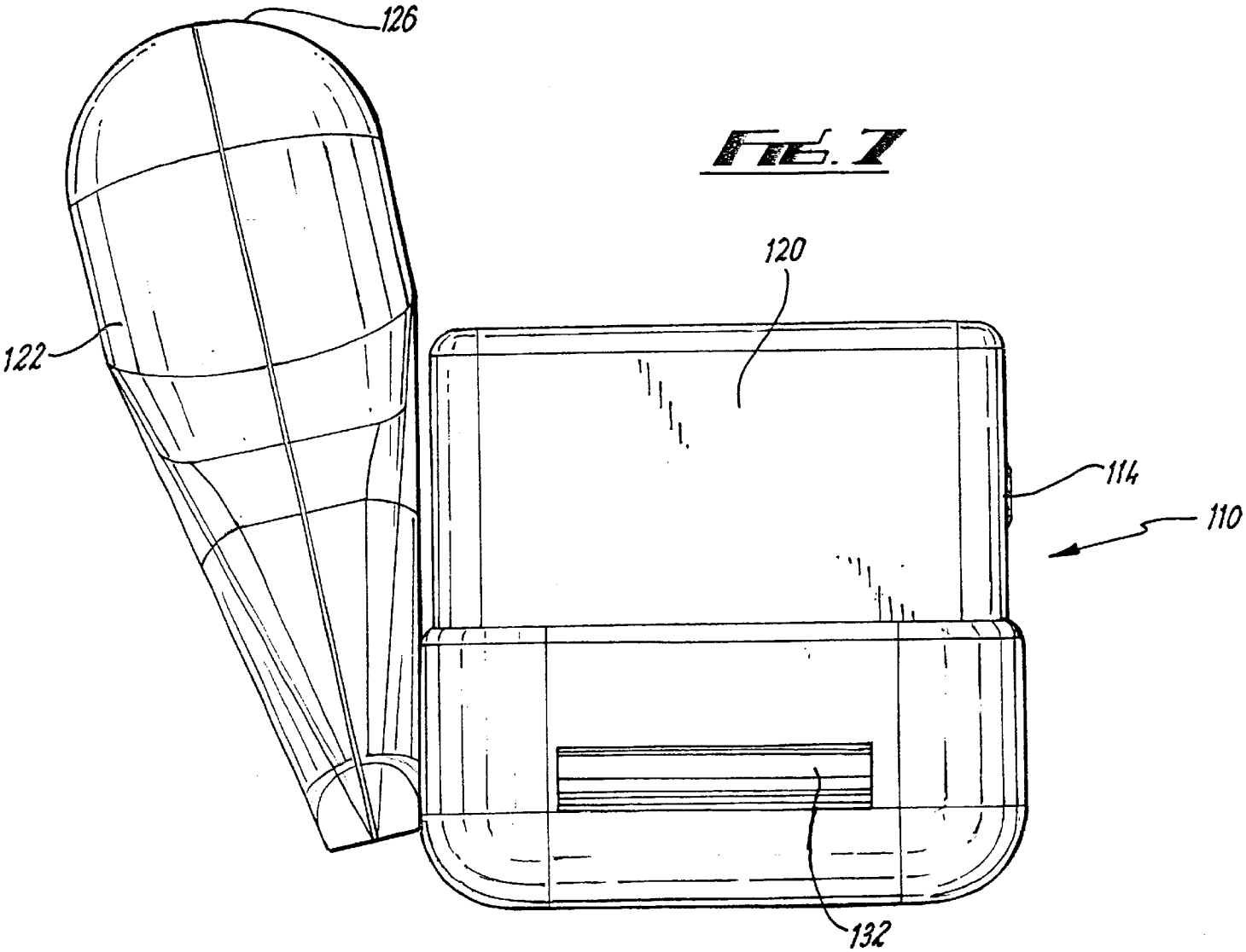
FIG. 7 is a diagrammatic side view of the bath lift part of FIG. 5; and, FIG. 8 is a similar view of FIG. 4 but of an alternative extra part.

FIGS. 5 to 7 of the drawings show an inflatable part 110 of a second bath lift. The part 110 is similar to the part 10 except as hereinafter described, and can be used in a similar manner. The part 110 again comprises a seat section 112 with an inlet 114. A base section 116 is provided beneath the seat section 112, and five holes 118 are provided therebetween.

The support section comprises two separate side sections 120 extending on either side of the seat section 112 and a rear section 122. Three holes 124 are provided between each side section 120 and the base section 116. Holes (not shown) are provided between the rear section 122 and base section 116.

The rear section 122 diverges upwardly from its mounting to the base section 116 and is provided with a rounded top 126. The rear section 122 is inclined rearwardly and also extends above the seat and side sections 112, 120 to about double their height.

The inflatable part 110 is used in a similar manner to the part 10 as follows and a similar mounting arrangement 132 is provided. As air is pumped through the inlet 114 with a person sitting on the seat section 112, air will pass from the section 112 into the section 116 and then into the sections 120 and 122. Initially the side and rear sections 120 and 122 will inflate to provide side supports and arm rests to a user and also rear support, with the rear section 122 acting as a back rest. With the rear section 122 extending upwardly beyond the side sections 120 good rear support is provided for a user of this bath lift. The upward divergence and rearwards inclination causes the rear section 122 to substantially align with the end of a bath. Once the side and rear sections are fully inflated the base section 116 and then seat section 112 will inflate. The part 110 can deflate in a similar manner to the part 10.

The shape of the rear section 122 raises a person to an upright sitting position during inflation of the part 110 thereby preparing them to exit the bath. During deflation of the part 110 the rear section 122 will gently deflate allowing the person to relax against the sloped end of a bath.

Figure 8:
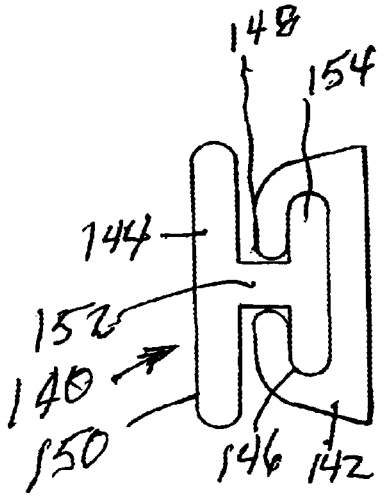

FIG. 8 shows an alternative mounting arrangement 140. The arrangement 140 comprises two profiled strips 142,144. The arrangement 140 comprises two profiled strips 142,144. The first strip 142 defines a channel 146 with a relatively narrow opening 148. The second strip 144 comprises a mounting band 150 from which extends a web 152. A crosspiece 154 extends transversely from either side of the free end of the web 152, such that the web 152 and crosspiece 154 define a T-shape cross-section turned through 90 degrees. The crosspiece 154 is restrainably locatable in the channel 146, with the web 152 extending through the opening 148.

Various other modifications may be made without departing from the scope of the invention. For instance, the bracing section could communicate with the support section rather than the base section. The inflatable part may have a different shape. A different mounting arrangement could be used, and in some instances it would be possible to use mounting arrangements such as suckers. Alternatively, magnetic mounting arrangements could be used, which may comprise complimentary magnetic members on the inflatable part and a bath or magnetic members on the inflatable part which are engageable with a metal bath.

Whilst endeavouring in the foregoing specification to draw attention to those features of the invention believed to be of particular importance it should be understood that the Applicant claims protection in respect to any patenable feature or combination of features hereinbefore referred to and/or shown in the drawings whether or not particular emphasis has been placed thereon.

What is claimed is:

1. A bath lift comprising:

a) an inflatable arrangement locatable in a bathtub such that a user can sit thereon and be raised as the inflatable arrangement is inflated, and lowered as the arrangement is deflated;

b) the inflatable arrangement including an inflatable seat section upon which a user can sit and an inflatable support section in fluid communication with the seat section;

c) the support section including parts on opposite sides of the seat section for supporting user arms and a back part in fluid communication with the support parts;

d) the seat section including an inlet port such that when a person is seated on the seat section and the sections are to be deflated from an inflated condition the seat section will deflate first and on reinflation the support section will inflate first;

e) the inflatable arrangement including anchoring means on opposite sides of the arrangement and coactable with a bath tub for maintaining the arrangement in a located position on a bathtub; and, f) interiors of the seat and support sections being interconnected by a series of chambers such that inflation air entering the support section has already passed through the seat section via a single valve in the seat section, and air exiting the support section passes into the seat section and out the valve.

2. The arrangement of claim 1 wherein when the support section is inflated and the seat section is at least partially deflated, the support section can provide support for a person sitting on the seat section.

3. A bath lift according to claim 1 wherein the anchoring means are magnets and at least some of the magnets are carried by the support section.

4. A bath lift according to claim 1, in which an inflatable bracing section is provided, which bracing section extends from at least the rear of the support section.

5. The bath lift of claim 4 wherein the bracing section is in fluid communication with the seat section and upon inflation from a deflated condition with a person seated upon the seat section, the bracing section will be substantially completely inflated before the seat section is inflated.

6. The lift of claim 1 wherein there is a support section positioned behind the seat section when the lift is in use.

7. The lift of claim 1 wherein the anchoring means is a pair of elongate strips which are relatively moveable longitudinally to establish and disconnect an interlocking relationship between the strips one of the strips being connected to the sections and the other strip being connectable, when in use, to a tube to coact with the one strip to secure the lift in place when in use.

8. The lift of claim 7 wherein a first of the strips defines a horizontally, when in use, open channel with an opening of reduced width and a second of the strips has a "T" shaped cross-section with a head extendible through the opening and a head disposable in the channel, when in use.

9. The lift of claim 1 wherein the anchoring means is a set of magnets secured to the lift for magnetic engagement with a bathtub.

10. A bath lift according to claim 1 wherein the anchoring means is a pair of elongate strips which are relatively moveable longitudinally to establish and disconnect an interlocking relationship between the strips one of the strips being connected to the sections and the other strip being connectable, when in use, to a bathtub to coact with the one strip to secure the lift in a place when in use.

11. A bath lift according to claim 10 wherein a first of the strips defines a horizontally, when in use, open channel with an opening of reduced width and a second of the strips has a "T" shaped cross-section with a head extendible through the opening and a head disposable in the channel when in use.

12. A bath lift according to claim 1 wherein each of the support section parts on opposite sides of the seat section has a portion of increased width at a free end of each side thereof.

13. A bath lift according to claim 1 wherein the support section includes a separate rear portion.

14. A bath lift according to claim 13 wherein the rear portion, when inflated, diverges upwardly.

15. A bath lift according to claim 13 wherein the rear portion, when inflated, in inclined rearwardly to, in use, conform to the shape of an end of a bathtub.

16. A bath lift according to claim 1 further including an inflatable base section positioned, in use, below the seat section.

17. A bath lift according to claim 16 wherein the base section is interconnected in series between the seat and support sections such that during inflation air enters the base section from the seat section, and air entering the support section enters from the base section.

18. A bath lift according to claim 1 wherein an inflatable bracing section extends from a rear of the support section.

19. A bath lift according to claim 18 wherein the bracing section increases in width upwardly, in use, generally conform to the shape of an end of a bathtub.

* * * * *